US009701328B2

(12) United States Patent
Martin et al.

(10) Patent No.: US 9,701,328 B2
(45) Date of Patent: Jul. 11, 2017

(54) RAILWAY SIGNAL CROSSING BYPASS

(71) Applicant: Modesto and Empire Traction Company, Modesto, CA (US)

(72) Inventors: Jared Martin, Turlock, CA (US); Steve Stanhope, Ceres, CA (US); Ron Peterson, Waterford, CA (US)

(73) Assignee: Modesto and Empire Traction Company, Modesto, CA (US)

( * ) Notice: Subject to any disclaimer, the term of this patent is extended or adjusted under 35 U.S.C. 154(b) by 0 days.

(21) Appl. No.: 15/267,003

(22) Filed: Sep. 15, 2016

(65) Prior Publication Data

US 2017/0072975 A1 Mar. 16, 2017

Related U.S. Application Data

(60) Provisional application No. 62/219,602, filed on Sep. 16, 2015.

(51) Int. Cl.

| | |
|---|---|
| ***B61L 29/08*** | (2006.01) |
| ***B61L 29/28*** | (2006.01) |
| ***B61L 29/04*** | (2006.01) |
| ***B61L 29/22*** | (2006.01) |

(52) U.S. Cl.

CPC ..... *B61L 29/28* (2013.01); *B61L 29/04* (2013.01); *B61L 29/22* (2013.01); *B61L 2207/00* (2013.01)

(58) Field of Classification Search

CPC ..... B61L 1/20; B61L 23/00; B61L 23/005; B61L 23/007; B61L 29/00; B61L 29/02; B61L 29/04; B61L 29/08; B61L 29/24; B61L 29/26; B61L 29/32

See application file for complete search history.

(56) References Cited

U.S. PATENT DOCUMENTS

| | | | | |
|---|---|---|---|---|
| 1,348,696 | A * | 8/1920 | Brown | B61L 29/26 246/294 |
| 1,714,417 | A | 5/1929 | Davis | |
| 1,934,429 | A | 11/1933 | Jenkins | |
| 4,365,777 | A | 12/1982 | Geiger | |
| 4,784,356 | A | 11/1988 | Fox | |
| 8,066,230 | B2 | 11/2011 | Honeck et al. | |
| 9,079,593 | B1 | 7/2015 | Burns | |
| 2004/0015275 | A1 | 1/2004 | Herzog et al. | |
| 2008/0169939 | A1* | 7/2008 | Dickens | B61L 29/226 340/910 |

FOREIGN PATENT DOCUMENTS

| | | |
|---|---|---|
| GB | 5321 A | 0/1915 |

* cited by examiner

*Primary Examiner* — R. J. McCarry, Jr.
(74) *Attorney, Agent, or Firm* — Marcus N. DiBuduo

(57) ABSTRACT

An apparatus for use with a railway safety system having a circuit for enabling and disabling a safety device when trains are approaching or within a railway crossing. The apparatus may include an override switch, a flag, and a light, and may generate a control signal received by and configured to override the safety device circuit. The flag and the light may indicate to approaching trains that the safety device of the railway safety system has been overridden.

28 Claims, 12 Drawing Sheets

(Conventional Railway Crossing)

(Conventional Railway Crossing)

RAILWAY SIGNAL CROSSING BYPASS

CROSS-REFERENCE TO RELATED APPLICATIONS

This application claims the benefit of U.S. Provisional Patent Application No. 62/219,602, filed on Sep. 16, 2015, which is hereby incorporated by reference in its entirety.

FIELD OF THE INVENTION

The present invention concerns bypass apparatuses for use in connection with railway signal crossing safety systems and methods of using the same. More particularly some embodiments of the present invention concern bypasses apparatuses for temporarily overriding electronic circuitry of railway signal safety systems and for providing visual indication to train crews when the safety system is malfunctioning or undergoing intended or preventative maintenance.

BACKGROUND

Railway crossings, sometimes referred to as "railroad crossings," "grade crossings," or "level crossings," are traffic intersections of railways and roadways (such as vehicular roads, paths, highways, or freeways) on the same plane. In typical configurations, railways and roadways are orthogonal, angled, or otherwise not parallel inside of the railway crossing. Trains and other rail vehicles are typically given the right of way inside of railway crossings because their significant mass and high speed makes it impossible or commercially impractical for them to stop at every railway crossing along a route.

The significant mass and speed of trains, and thus their kinetic energy, unfortunately also presents significant risk of fatal collisions with passenger and other road vehicles inside of railway crossings. It is estimated that over 300 people are killed each year in the U.S. alone in railway crossing collisions. In one example, a freight train collided with a municipal bus carrying impaired seniors and young adults in a Pennsylvania intersection in April 2013 resulting in the death of one passenger and the hospitalization of nearly a dozen others.

In an effort to prevent collisions between trains and vehicles in railway crossings, various safety systems have been used. The safety systems can be classified as passive or active. Passive safety systems may include safety devices such as warning signs, lights, and/or other devices which are placed and designed to notify or warn drivers of vehicles that the intersection contains a railway that might have an approaching train and that they should proceed with caution. Active safety systems may contain safety devices such as audible notification devices (such as bells or horns), visual notification devices (such as lights), barriers (also known as "preclusion devices", such as mechanical crossing gates, sometimes referred to as "boom gates"), and/or other devices which are placed and designed to notify drivers of vehicles that a train is approaching, has entered, or is within the intersection. In a typical configuration, an active safety system may include mechanical crossing gates on both sides of the roadway. When a train is approaching or within the intersection, the mechanical crossing gates descend above the roadway preventing vehicles from entering the intersection. The active safety systems can further include visual notification to drivers of vehicles, such as lights, which may be placed on the gates, or audible notification, such as bells.

Active railway safety system designs are varied, though most contain some form of electronic circuitry to identify an approaching train, and activate the notification devices and/or barriers. The circuitry is contained in a "signal house" (or "signal case") and is maintained by a qualified railway person known as a signalman. In the simplest form, the safety system may electronically sense when an approaching train is within a certain distance from the intersection, and then activate the notification devices and barriers may be activated. In more complex safety systems, the safety system may be interconnected to other crossings or system controllers, and may be configured to coordinate with nearby roadway traffic control signals. The railway safety system may include relays, solid state or digital circuitry, computers, or programmable logic controllers for selectively activating and deactivating the safety devices. For example, relays may be associated with a safety device, such as a motor lowering and raising a gate, or a circuit activating light or a bell. In some systems, when the safety system detects an approaching train, a signal will be provided to the primary (or coil) of the relay to activate the safety device. Some conventional systems detect approaching trains by energizing the rails of a portion of the rail track, and detecting when the rails are shunted within the portion of the track by the train wheels and axles. Other conventional systems detect approaching trains by one or more tuned audio frequency detectors placed along the rail track to detect the proximity of a train near the audio frequency detectors. The railway safety systems typically have circuitry receiving the output of the detector and activating or deactivating the safety devices in response thereto, for example, by opening or closing a relay associated with the safety device. Some modern railway safety systems may also be configured to receive additional signals and activating or deactivating the safety devices in response thereto.

Unfortunately safety systems are prone to the occasional malfunction, which can result in dangerous collisions. In July 1967, a crossing gate got snagged with an overhead telegraph wire in a German railway crossing, which prevented the closure of the crossing gate. A railway worker manually opened the gate before the arrival of a train in order to free the snagged gate, however, he neglected to signal the train to stop before the intersection. A fuel tanker mistook the open crossing gate as an indication that it was free to pass, at which time it was struck by the train and exploded, causing the death of nearly 100 individuals.

When safety system malfunctions occur, or the safety system is otherwise needed to be maintained, railway personnel are called to fix the problem. Depending on the severity of the problem it may take hours or days to fix or maintain the safety system. In the interim, trains and vehicles still need to continue to use the intersection. The variability of railway intersections (i.e., some intersections may have only passive warning lights, while others may include one or more gates, while others may coordinate with roadway traffic control signals) and the variability of the electronic circuitry within the signal house or signal case makes it difficult for general railway personnel to manually control the intersection or fix the problem.

Some conventional approaches to overriding the railway safety system include jumping the contacts of the relay associated with the safety device so as to open or close the relay to manually activate or deactivate the safety device. In some instances, during a malfunction or maintenance, the signalman temporarily rewires the electronic circuitry (for example, by using jumper or patch cables) to cause a desired outcome at the railway intersection. For example, when a malfunction causes a gate to remain closed when there is no approaching train, a signalman may jumper portions of the electronic circuitry (such as jumping relay control terminals) to temporarily raise the crossing gates to permit vehicles to pass through the intersection. The signalman may also notify nearby train crews that there is a malfunction in, or maintenance of, the safety system such that they will approach with caution or notify the signalman of their impending approach so that the signalman can temporarily lower the gates by jumping portions of the electronic circuitry. Once the signalman has completed the repairs, he or she may remove all jumper or patchwork to return the electronic circuitry to its automated state.

It is to be appreciated that the circuitry within the signal house of one intersection may be different than the circuitry within the signal house of another intersection, thus access to the circuitry of the safety system is limited to select railway personnel that are qualified to maintain and knowledgeable with the signal house or signal case circuitry at a specific crossing. Non-qualified railway personnel are unable to override the railway safety system, and in most situations, only qualified signalmen may be capable of acting when a safety system malfunction occurs.

What is needed, therefore, is an apparatus which permits general railway personal without an understanding of the safety system circuitry, and without access to the circuitry within the signal house, to temporarily override portions of a railway safety system.

SUMMARY OF THE INVENTION

Embodiments of the present invention pertain to apparatuses which can be used in connection with railway safety systems that can be used to override safety systems. In one embodiment, the apparatus can be mounted outside of the signal house and can provide one or more control signals to the electronic circuitry of the safety system. The apparatus can include flags, lights, or other visual indications to train crews that the safety system has been overridden, and can be operated by railway personal not familiar with or qualified to work on the electronic circuitry of the particular intersection's safety system.

In some embodiments of the present invention, an override apparatus for use with a railway safety system can include one or more switches, flags, and lights. The apparatus may be mounted or adjacent to the signal house or signal case and wires may extend from an interior of the apparatus to an interior of the signal house or signal case. However it is to be appreciated that the apparatus may be positioned a distance from the signal house or signal case and may include wireless transceivers for communicating with the circuitry in the signal house or signal case.

In some embodiments, the apparatus may include at least two states: the first state in which the apparatus does not override any portion of the automatic railway safety system; and the second state in which the apparatus overrides a portion of the automatic relay system. In the second, override state, the apparatus may be configured to electronically control a portion of the railway safety system to activate or deactivate one or more safety devices. For example, and without limitation, in the second state the apparatus may cause the railway safety system to raise or lower a barrier, activate or deactivate a light, and/or activate or deactivate a bell. It is to be appreciated that depending on the safety devices present in a specific railway crossing, the apparatus may include more than two states. For example, the apparatus may have a first state, a second state where a first set of safety devices are activated or deactivated, and a third state where a second set of safety devices are activated or deactivated.

The apparatus may include one or more visual identifiers, such as a flag or a light to notify approaching trains of the state of the apparatus. In preferred embodiments, at least two visual indicators can be provided: one identifier for use in high ambient light conditions (e.g., daytime) and one identifier for use in low ambient light conditions (e.g., nighttime). In some embodiments, the apparatus may include a flag that can have a first position when the apparatus has a first state and a second position when the apparatus has a second state. For example, and without limitation, the flag may have a first position where its surface is positioned parallel relative to the approach path of the train (and thus not in a notifying position) and a second position where its surface is positioned tangential to the approach path (and thus in a notifying position). However it is to be appreciated that in accordance with some embodiments of the present invention the flag may have two surfaces (i.e., a front and back) and may have any number of positions for conveying the state of the apparatus to approaching trains. Similarly, in accordance with some embodiments, the apparatus can have multiple flags for conveying the state of the apparatus to approaching trains. The apparatus may also include lights to notify approaching trains. In some examples, and without limitation, the apparatus can include a light source directed parallel and opposite to the approach path of the train such that approaching trains can view the light source, and determine therefrom the state of the apparatus. In some embodiments, the apparatus can have a single light for identifying two states of the apparatus (for example, and without limitation, the light can be on or off). However it is to be appreciated that the apparatus can include a plurality of lights or a plurality of colors for indicating multiple states of the apparatus. Similarly, the light can be configured with multiple illumination states and patterns for conveying the state of the apparatus (for example, and without limitation, in a first state the light can be off, in a second state the light can be constantly on, in a third state the light can blink slowly, and in a fourth state the light can blink rapidly). It is to be appreciated that apparatuses in accordance with embodiments of the present invention can include any number of flags, lights, or other visual identifiers to provide visual notify approaching trains of the state of the apparatus in different ambient light conditions.

The apparatus may have one or more state selection devices for placing the apparatus in one of the plurality of states. In some embodiments, the state selection device may include a lever having a first position and a second position, though it is to be appreciated that any number of positions are contemplated in accordance with some embodiments of the present invention. In some implementations, the state selection device may comprise a rotatable lever having a first position and a second position. In some other implementations, the state selection device may comprise a toggle switch. In yet some other implementations, the state selection may comprise a push button switch. However it is to be appreciated that other state selection devices are contemplated in accordance with some embodiments of the present invention.

The state selection device of the apparatus may be operatively engaged with one or more electrical and/or mechanical devices for selecting the state of the apparatus. In some implementations, the state selection device may be operatively engaged with electromechanical switches connected to circuitry for enabling or disabling an approaching train notification light corresponding to a state of the apparatus. In some implementations, the state selection device may be operatively engaged with an approaching train notification flag. For example, and without limitation, the state selection device may comprise a rotatable lever and the approaching train notification flag may be engaged at a distal end of the lever and positioned on the outside of the apparatus. In some implementations, and as discussed below, the state selection device may be engaged with one or more override switches configured to generate a control signal received by and configured to override the circuitry associated with a railway safety system safety device (for example, and without limitation, a crossing gate, light, or bell to notify vehicles and/or prevent entry into a railway crossing.).

In some implementations, the state selection device can comprise a rotatable lever with a flag engaged on a distal end thereof and extending outside of the interior of the apparatus, and one or more cams engaged on a shaft of the lever and operatively engaged with one or more cam switches in an interior area of the apparatus for enabling the approaching train notification light and/or generating the override control signals. For example, and without limitation, rotation of the lever from a first position to a second position may (i) transition the apparatus from a first state to a second state, (ii) rotate an approaching train notification flag from a first position to a second, notifying position, (iii) via cams engaged with the lever, cause circuitry to illuminate an approaching train notification light to activate, and (iv) via cams engaged with the lever, cause circuitry to generate one or more override control signals for overriding the safety devices of the railway safety system.

It is to be appreciated however that other implementations are contemplated in accordance with some embodiments of the present invention. For example, and without limitation, the apparatus can include solid state, electronic, computerized, or programmable logic in combination with electronic state selection device (such as a button or switch) for activating the train notification light and/or generating the override control signal(s). In some embodiments an approaching train notification flag may be engaged to a distal end of a shaft and a motor or gear can transition the flag from a first position to a second position.

As discussed, preferred embodiments of the present invention are directed towards apparatuses for overriding portions of a railway safety system that is malfunctioning or under intended or preventative maintenance so that trains and vehicles can continue to use the railway crossing while needed repairs are made. In some embodiments, apparatuses of the present invention enable railway personnel whom are unfamiliar or unqualified with the railway safety system circuitry inside of the signal house or signal case to override the safety system to, for example and without limitation, manually raise or lower traffic gates, activate or deactivate warning lights or bells, or control roadway traffic signals.

Embodiments of the present invention include apparatuses that may be operated from outside of the signal house or signal case which generate one or more control signals that are operatively connected with the railway safety system circuitry. For example, and without limitation, an apparatus in accordance with some embodiments of the present invention may include a rotatable lever operable with a cam switch that is electrically connected to the primary (or coil) of a relay located in the signal house or signal case that is associated with the safety device. Qualified railway personnel may install the apparatus and appropriately connect the cam switch of the apparatus to the corresponding relay in the signal house or signal case. Thereafter non-qualified railway personnel can operate the lever of the apparatus, effectively jumping the relay associated with the safety device which is to be overridden.

In some other embodiments, the switch of the apparatus may be electrically connected to other portions of the railway safety system for activating or deactivating the safety devices in response thereto. For example, the railway safety system may include digital inputs for overriding the approaching train detectors and activating or deactivating one or more safety devices. It is to be appreciated that embodiments of the present invention pertain to apparatuses generating override control signals electrically connected to and received by the circuit of the railway safety system for overriding one or more safety devices that are controlled in a default state automatically by the railway safety system, and that the present invention is not to be limited by any particular portion of the railway safety system circuitry which receives the override control signals.

In some embodiments, an override apparatus can include a switch generating a control signal received by the safety device circuit, a flag, a light, and an external housing, each the control signal, the flag, and the light having a first position or state. In the second state, the control signal can cause the safety device circuit to be placed in override mode.

In some embodiments, an override apparatus can include a housing in proximity to the signal house, a rotatable lever extending through a portion of the housing, a flag at a distal end of the lever, a light activated and deactivated by rotation of the lever, and a cam on the lever engaged with a switch for generating a control signal received by the safety system circuit.

In some embodiments, a system for overriding a portion of a railway safety system can include a safety device in the railway crossing, a circuit for activating and deactivating the safety device positioned in the signal house, and an override apparatus. The override apparatus can be disposed on or near (proximate) the signal house. The override apparatus can include a switch generating a control signal received by the circuit in the signal housing. The override apparatus can include a flag with a first position and a second position and a light. In a first state, the safety device may be activated, the flag may have the first position, and the light may be deactivated. In the second state, the safety device may be deactivated, the flag may the second position, and the light may be activated. In the second position, the flag and the light may provide a visual indication to a train approaching that the safety device is deactivated or overridden. The override apparatus may include a lever with a cam that is operably engaged with the switch, and in some implementations, the flag may be engaged at a distal end of the lever.

DESCRIPTION OF PREFERRED EMBODIMENTS

The invention, in its various aspects, will be explained in greater detail below. While the invention will be described in conjunction with several exemplary embodiments, the exemplary embodiments themselves do not limit the scope of the invention. Similarly, the exemplary illustrations in the accompanying drawings, where like elements have like numerals, do not limit the scope of the exemplary embodiments and/or invention. Rather the invention, as defined by the exemplary claims, may cover alternatives, modifications, and/or equivalents of the exemplary embodiments.

Figure 1:
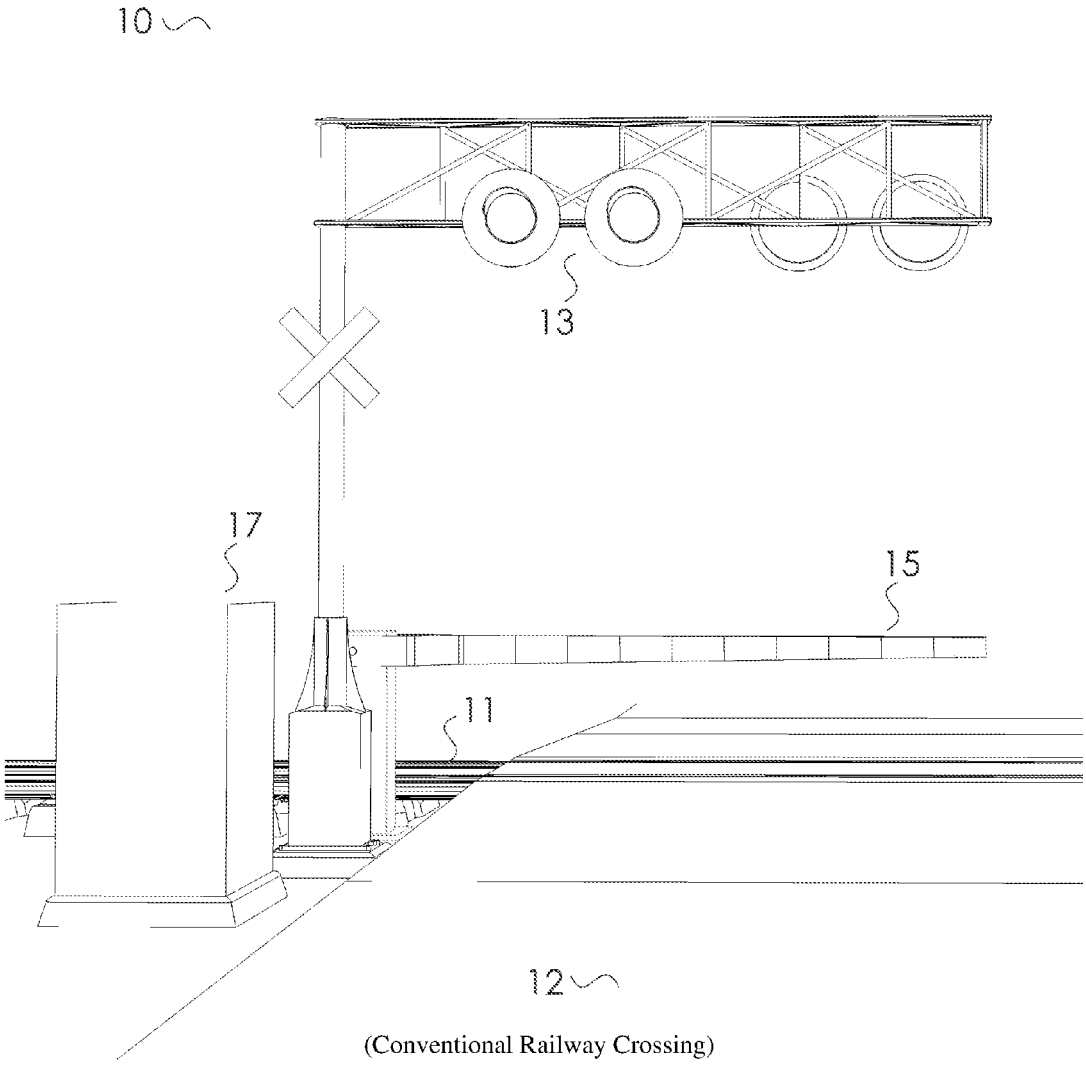
FIG. 1 is a drawing illustrating a conventional railway crossing with a safety device activated.
Figure 2:
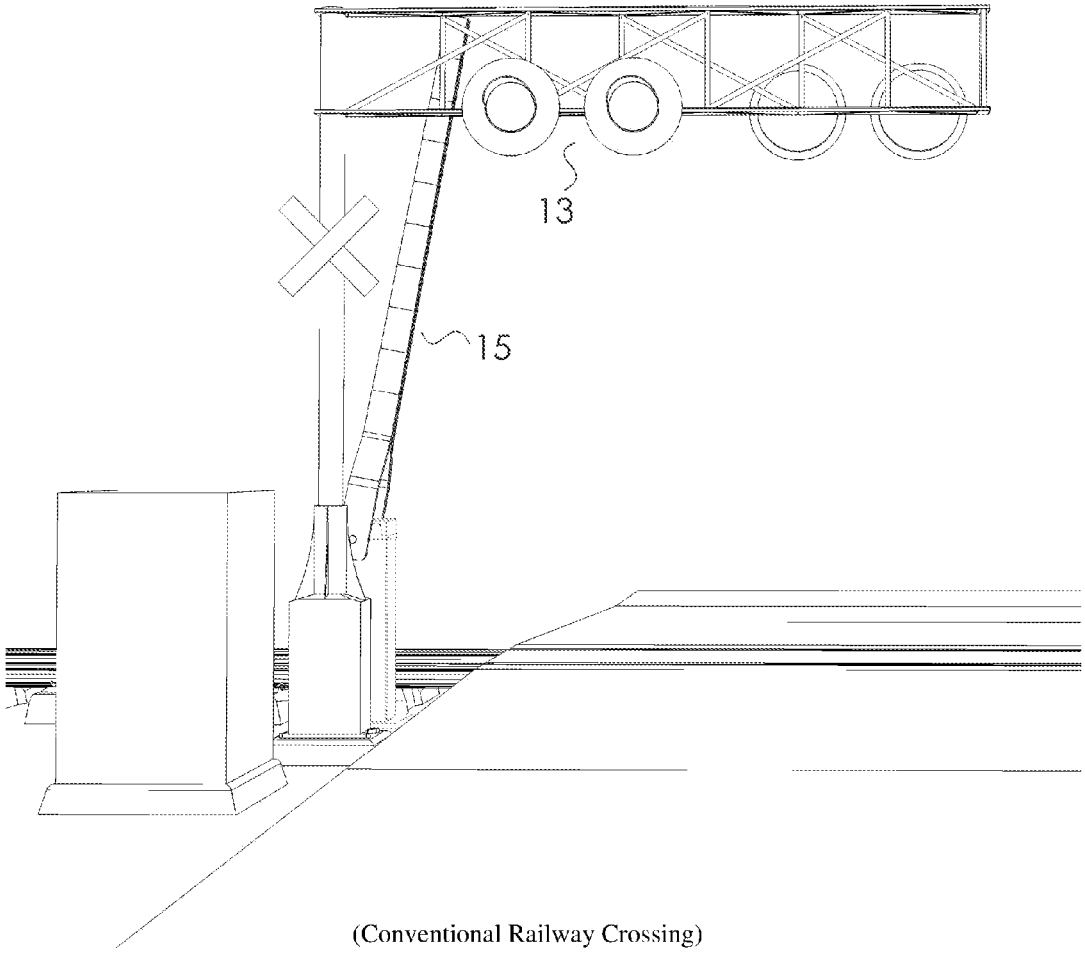
FIG. 2 is another drawing of the railway crossing of FIG. 1, with the safety device deactivated.

Referring now to the exemplary illustrations, and specifically to FIGS. 1 and 2, railway crossing 10 may include railway 11 upon which a train may travel and roadway 12 upon which vehicles may travel. Railway crossing 10 may include one or more safety devices, such as, without limitation, visual notification device 13 (which may be, but is not limited to, one or more lights) and/or barrier 15 (which may be, but is not limited to, a boom gate). Visual notification device 13 may notify drivers of vehicles upon roadway 12 that a train is approaching or within railway crossing 10. Barrier 15 may preclude entry of vehicles upon roadway 12 from entering railway crossing 10 when a train is approaching or within railway crossing 10. In some implementations, railway crossing 10 may also include signal house 17, which may contain electronic circuitry (not shown) controlling the safety devices. For example, and without limitation, signal house 17 may contain electronic circuitry connected to visual notification device 13 so as to enable it to flash or illuminate when a train is approaching railway crossing 10. In additional examples, and without limitation, signal house 17 may contain electronic circuitry connected to a motor associated with barrier 15 lowering barrier 15 when a train is approaching railway crossing 10. In ordinary operation, and as illustrated in FIG. 2, when a train is not near or within railway crossing 10, visual notification device 13 may be deactivated (i.e., not flashing or illuminated) and/or barrier 15 may have a near upright position permitting passage of vehicles on roadway 12. As illustrated in FIG. 1, when a train is near or within railway crossing 10, visual notification device 13 may be activated (i.e., flashing or illuminated) and/or barrier 15 may have a near horizontal position precluding passage of vehicles on roadway 12. The activating and deactivating of the safety devices (for example, and without limitation, visual notification device 13 and/or barrier 15) may be controlled by signal house 17 depending on whether a train is near or within railway crossing 12. It is to be appreciated that the railway safety system (including, without limitation, signal house 17, visual notification device 13, and barrier 15) is ordinarily configured to activate the safety devices when there is a malfunction. Thus, even if no train is approaching, if the railway safety system has a malfunction or is otherwise needed to be maintained, conventional railway safety systems are configured to activate the safety devices (for example, and without limitation, by causing visual notification device 13 to flash or illuminate and lower barrier 15).

Figure 3:
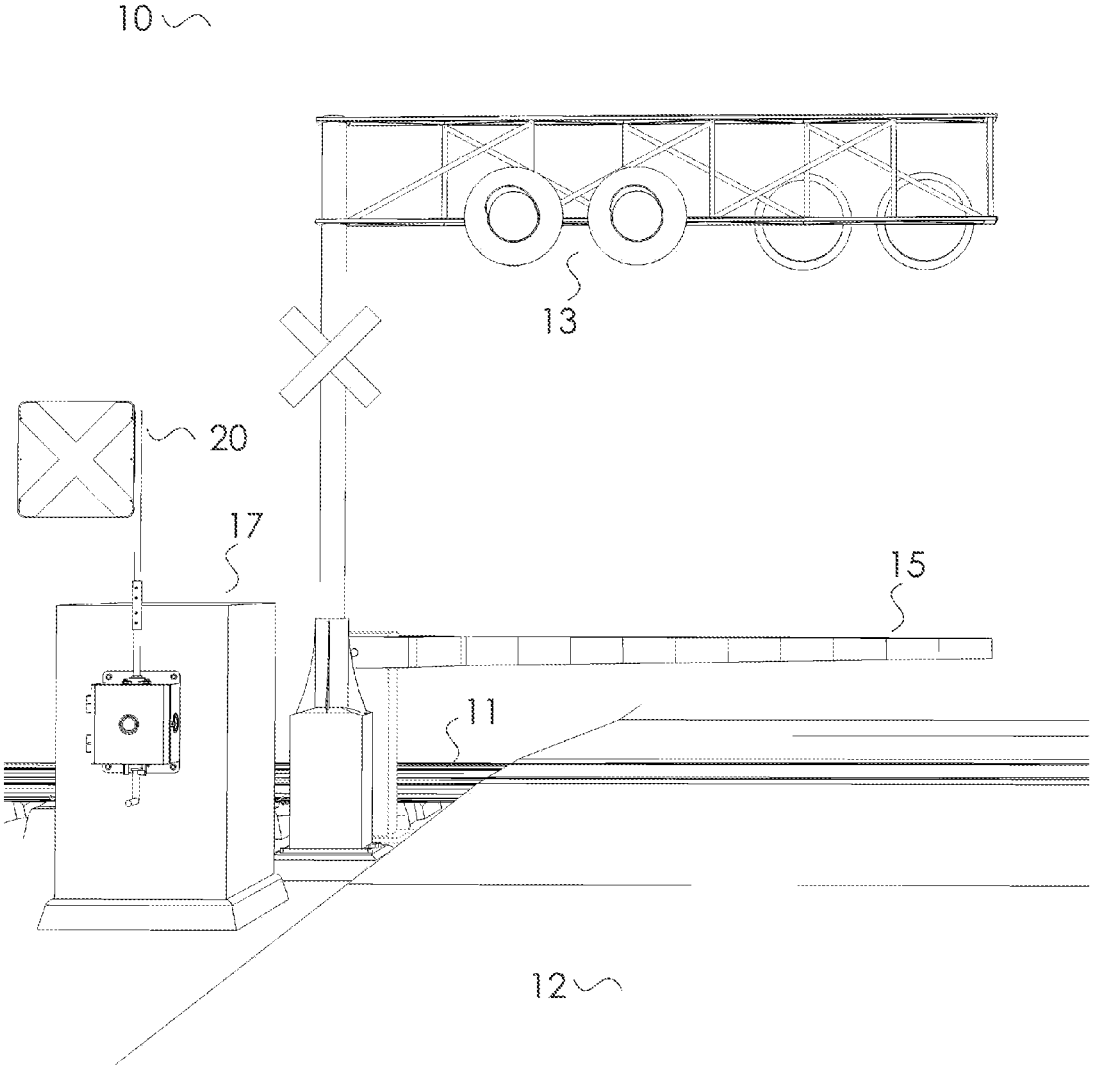
FIG. 3 is a drawing illustrating a railway crossing in accordance with some embodiments of the present invention, with a safety device activated.
Figure 4:
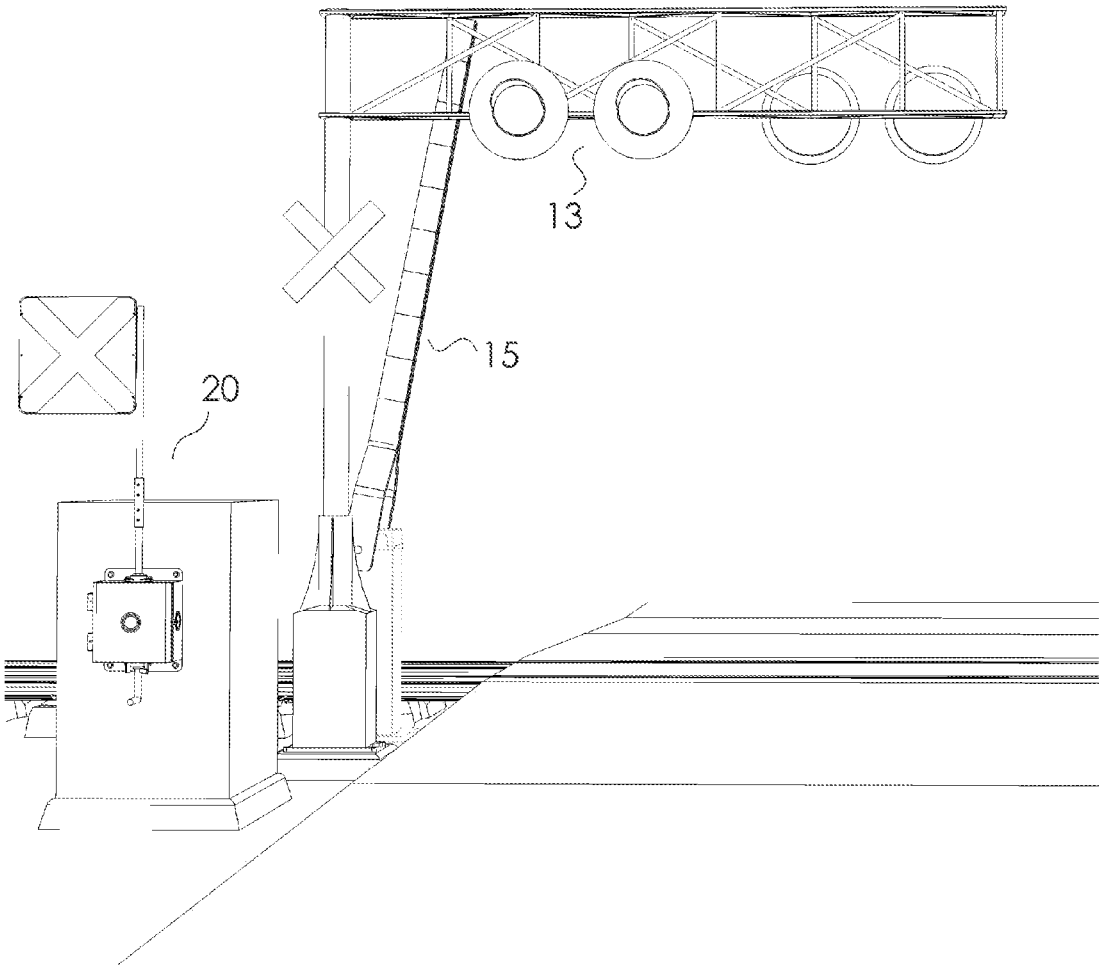
FIG. 4 is another drawing of the railway crossing of FIG. 3, with the safety device deactivated.
Figure 5:
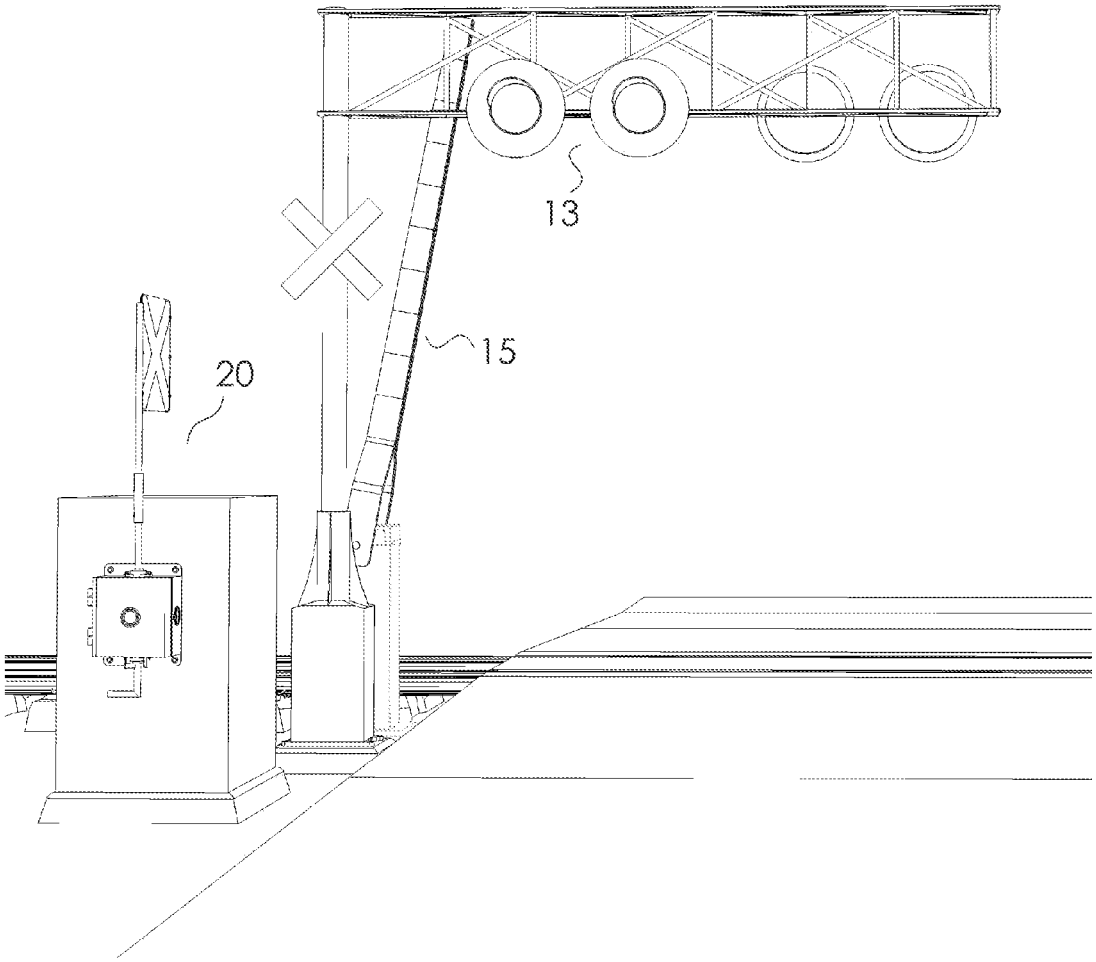
FIG. 5 is another drawing of the railway crossing of FIG. 3, with the safety device in override mode.

In some embodiments of the present invention, and referring now to the exemplary illustrations of FIGS. 3-5, override apparatus 20 may be disposed proximate to signal house 17. Override apparatus 20 allows for one or more portions of signal house 17 controlling the safety devices to be placed in an override mode. For example, and without limitation, in ordinary operation, and as illustrated in FIG. 3, when a train is near or within railway crossing 10, visual notification device 13 may be activated (i.e., flashing or illuminated) and/or barrier 15 may have a near horizontal position precluding passage of vehicles on roadway 12. And as illustrated in FIG. 4, when a train is not near or within railway crossing 10, visual notification device 13 may be deactivated (i.e., not flashing or illuminated) and/or barrier 15 may have a near upright position permitting passage of vehicles on roadway 12. During a malfunction or maintenance of the railway safety system, in accordance with some embodiments of the present invention, and as shown in FIG. 5, the override apparatus 20 may be configured between a first state and a second state, wherein in the second state, one or more safety devices can be deactivated (i.e., visual notification device 13 may not flash or be illuminated and barrier 15 may have a near upright position. Thus it is to be appreciated that embodiments of the present invention include an override apparatus which has a first state permitting normal operation of the railway safety system and a second state in which one or more safety devices are deactivated.

Figure 6:
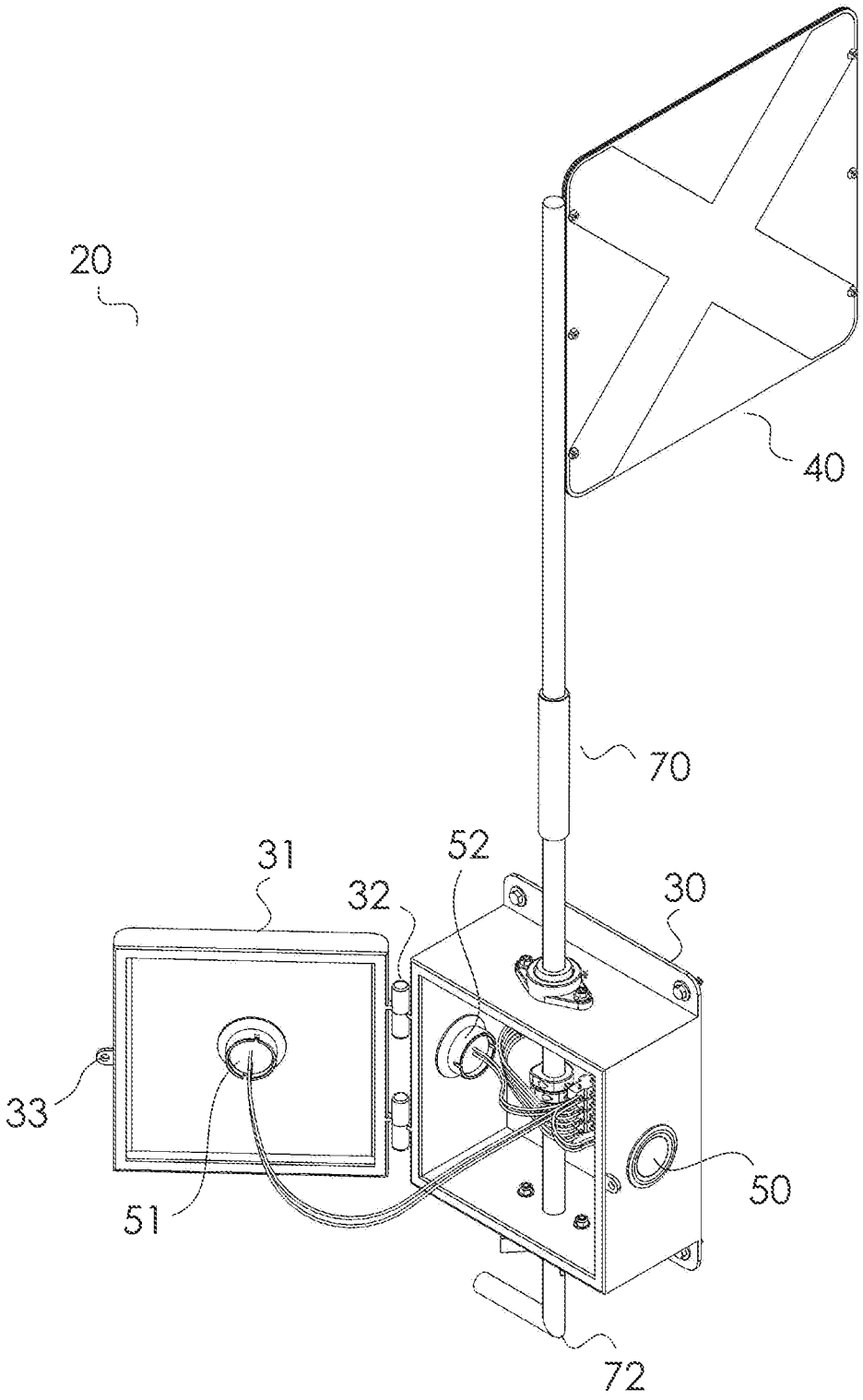
FIG. 6 is a drawing illustrating an override apparatus in accordance with some embodiments of the present invention.

Referring now to the exemplary illustration of FIG. 6, override device 20 may include housing 30, flag 40, and one or more lights 50, 51, 52. In some implementations, housing 30 may include door 31 which may be engaged with the body of housing 30 by one or more hinges 32. Door 31 may be secured with body of housing 30 by locking mechanism 33. In some examples, and without limitation, locking mechanism 33 may comprise holes through which a padlock (not shown) may be engaged through to restrict access to override mechanism 20 to authorized railway personnel. In some embodiments override device may include lever 70, which may extend through a portion of housing 30. Lever 70 may include a handle 72 for rotating lever between at least two positions, as discussed more fully herein. Flag 40 may be engaged to a distal portion of lever 70.

It is to be appreciated that, in some embodiments, flag 40 and lights 50, 51, 52 should be positioned relative to housing 30, and override apparatus 20 should be positioned relative to signal house 17 and railway crossing 10, such that approaching trains can see flag 40 and one or more of lights 50, 51, 52 so as to provide a visual indication to a train approaching railway crossing 10 that the railway safety system has been bypassed. In some implementations, override apparatus 20 may be include only light 50 and 52 (for example, and without limitation, as shown in the illustration of FIG. 5 when override apparatus 20 is mounted on a side of signal house 17 perpendicular to the direction of railway 11). Similarly, in some implementations, flag 40 may be disposed at a position such that it may be seen by approaching trains (for example, and without limitation, as shown in the illustration of FIG. 5 when the flag has a surface facing the direction of railway 11). Other configurations and orientations of flags and lights are contemplated in accordance with embodiments of the present invention.

Figure 7:
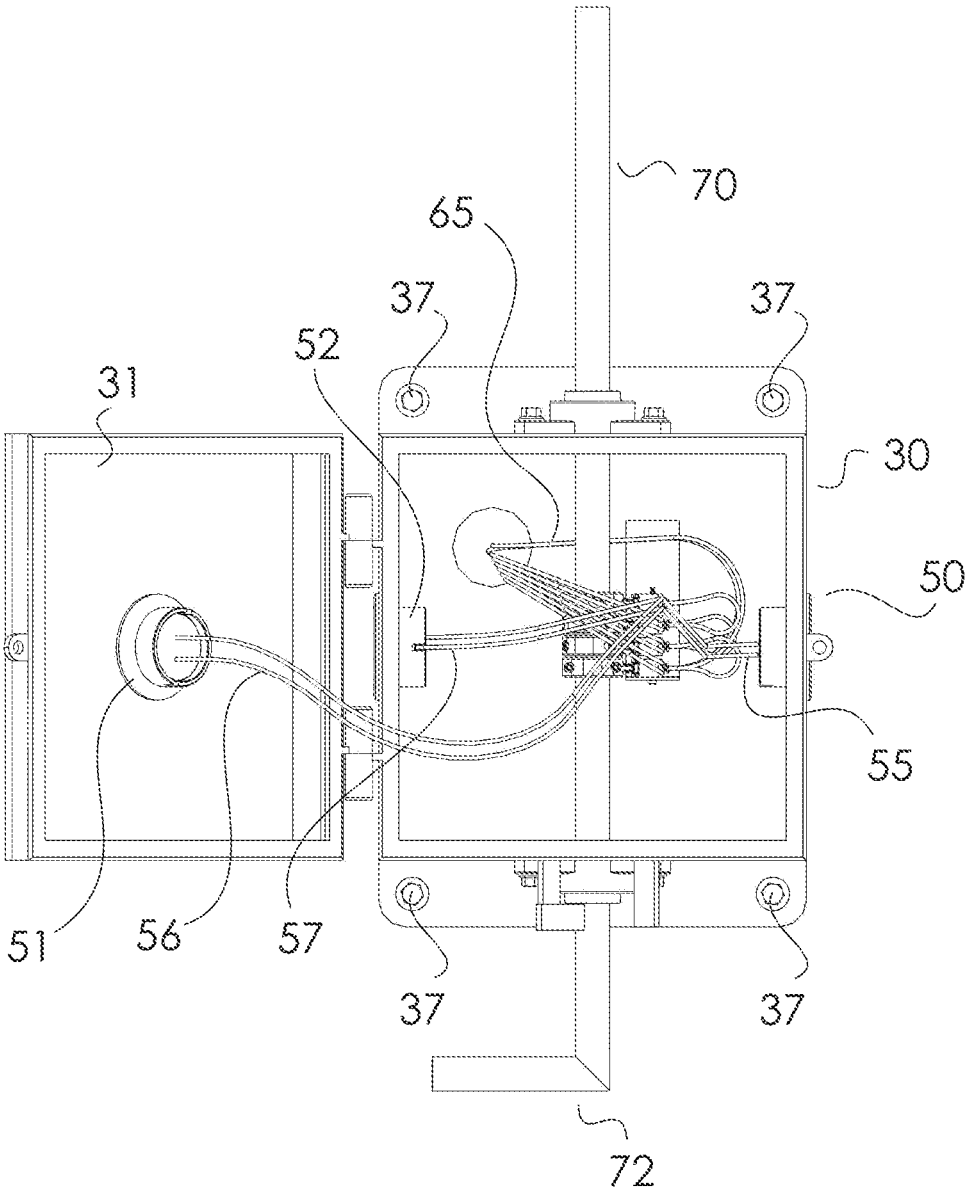
FIG. 7 is a front-view drawing illustrating a portion of an override apparatus in accordance with some embodiments of the present invention.
Figure 8:
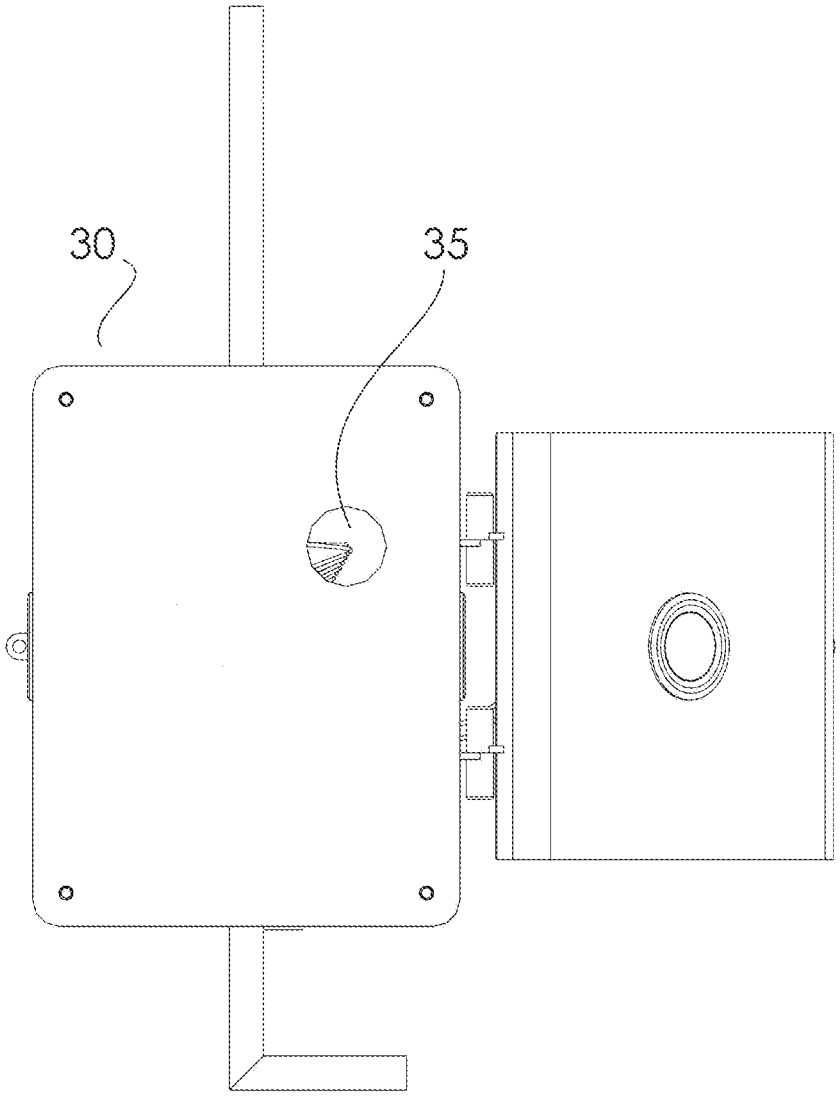
FIG. 8 is back-view drawing of the override apparatus of FIG. 7.

Referring now to the exemplary illustrations of FIGS. 7 and 8, the override apparatus may include attachment devices 37 for fixedly engaging housing 30 to the signal house. In some examples, and without limitation, attachment devices 37 may comprise bolts extending through a flange on housing 20 which may be secured in a side wall of the signal house. In other examples, the attachment devices may be provided inside the inner cavity of housing 30. It is to be appreciated that, in some implementations and as discussed more fully herein, the override apparatus may have one or more switches generating a control signal received by electronic circuitry in the signal house. In some embodiments, the control signal may be provided over wires which are electrically tied to electronic circuitry in the signal house. For example, and without limitation, the override apparatus may include wires 65 positioned in an inner cavity of housing 30 and which may pass through opening 35 in housing (as shown in FIG. 8) to the circuitry in the signal house. It is to be appreciated that wires 65 may comprise any number of wires, which may transmit the control signal from the override apparatus to the circuitry in signal house and which may receive power from the signal house provided to the override apparatus. In some embodiments, wires 55 may provide power and/or control to light 50, wires 56 may provide power and/or control to light 51, and wires 57 may provide power and/or control to light 52.

Figure 9:
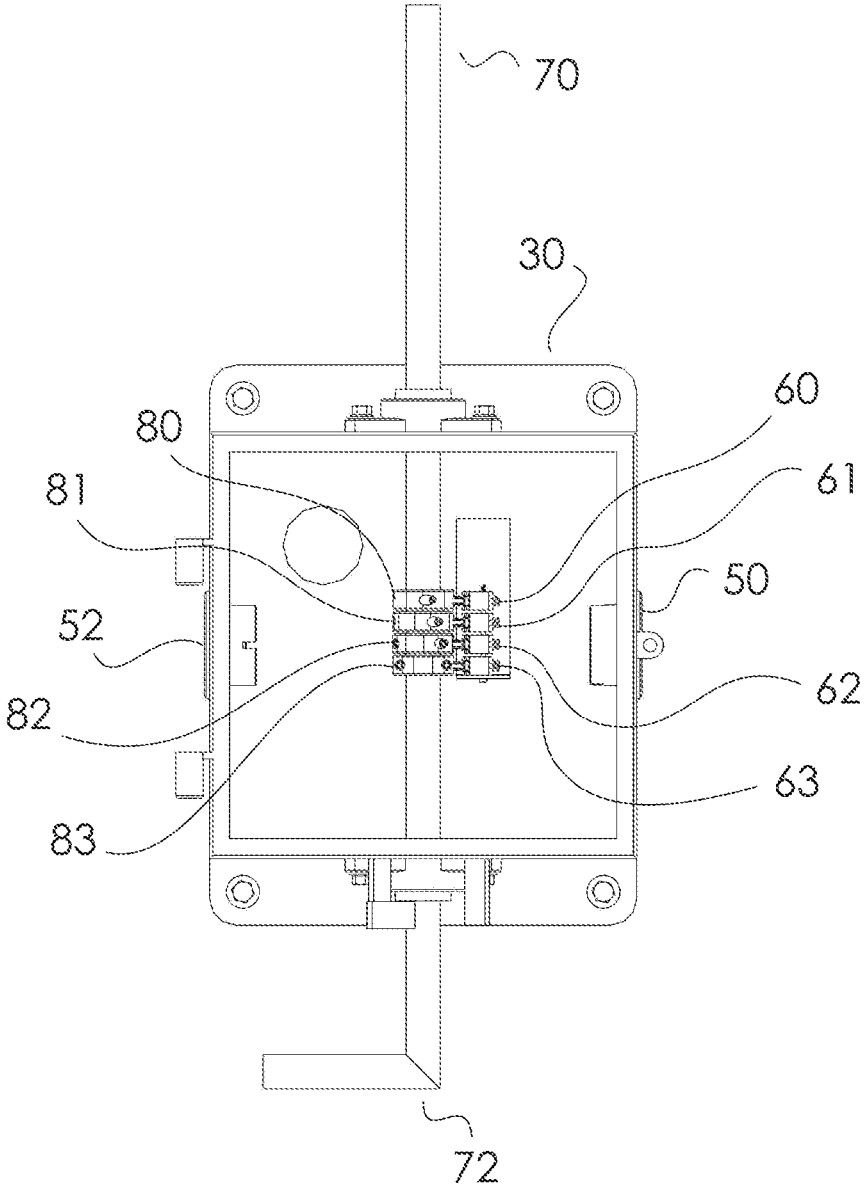
FIG. 9 is a front-view drawing illustrating a portion of an override apparatus in accordance with some embodiments of the present invention.
Figure 10:
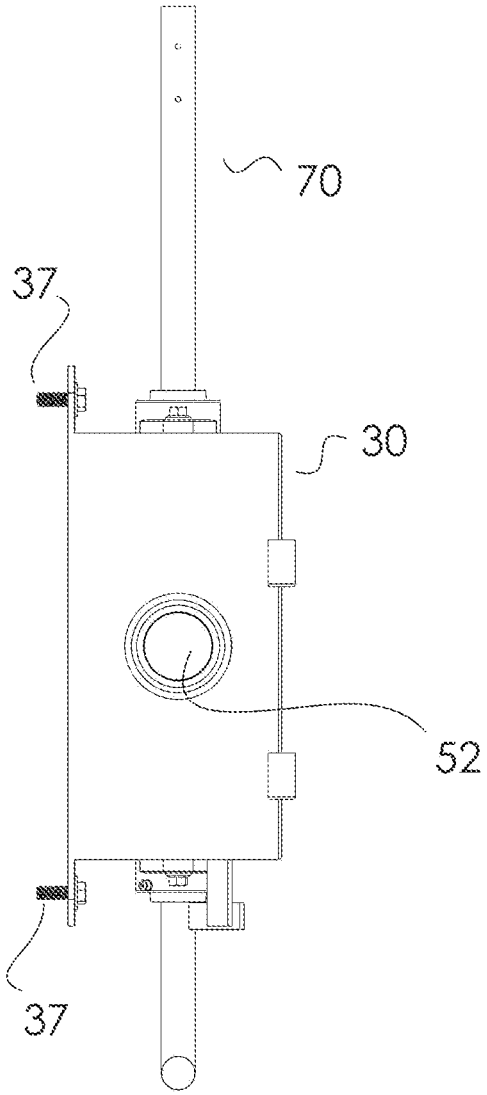
FIG. 10 is a side-view drawing of the override apparatus of FIG. 9.
Figure 11:
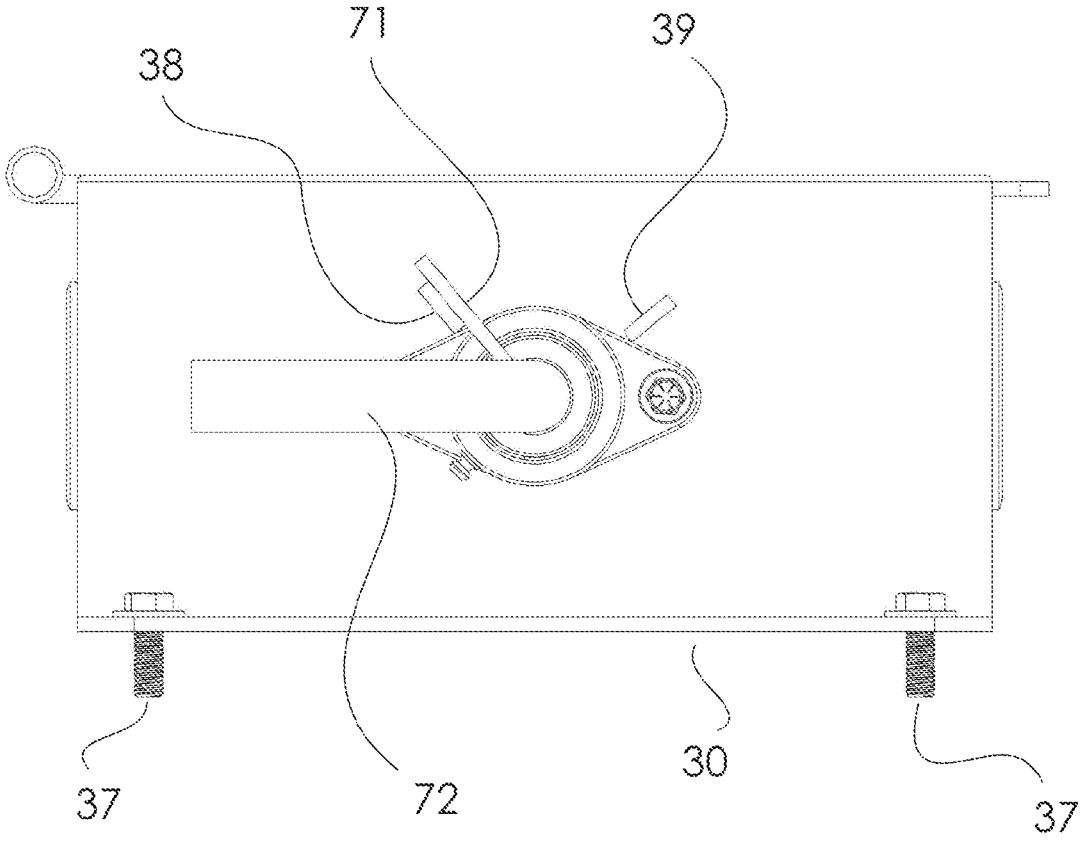
FIG. 11 is a bottom-view drawing of the override apparatus of FIG. 9.

Referring now to the exemplary illustrations of FIGS. 9-11, wherein for illustration purposes the wires and door have been removed, the override apparatus may include one or more switches for generating the control signal provided to the circuitry in the signal house, and one or more switches for activating the lights. For example, and without limitation, switch 60 may generate a control signal, and switches 61, 62, 63 may activate the lights (for example, lights 50, 51, 52). It is to be appreciated that in preferred embodiments, and discussed herein, switch 60 generating a control signal may be operatively engaged with a cam on a rotatable lever. However, in some embodiments of the present invention, switch 60 (and switches 61, 62, 63) may consist of one or more toggle or push button switches on an interior or exterior of housing 30. Other switches and positions thereof are contemplated in accordance with embodiments of the present invention.

In preferred embodiments, the override apparatus can include lever 70 (shown extending through the bottom and top of housing 30) for selecting a state of the apparatus. The bottom of lever 72 may include handle 72 which can be operated by a user, and may be positioned outside of housing 30. Flag 40 may be fixedly engaged at a top or distal portion of lever 40 and have a surface for indicating the state of override apparatus 20 to trains (as illustrated in FIG. 6). The positioning of the override apparatus and flag 40 is such that approaching trains can see the surface of flag 40 when the override apparatus is in a second state, as illustrated generally in FIG. 5, and cannot see the surface of flag 40 when in a first position, as illustrated generally in FIG. 3 and FIG. 4.

In some embodiments lever 70 may have a first position and a second position (and thus flag 40 fixedly engaged thereto may have a first position and a second position). Handle 72 can be operated by a user to rotate lever 70 between the first position and the second position. In some embodiments, and as illustrated in FIG. 11, the lever may include tab 71 and housing 30 may have stoppers 38, 39 (for example, and without limitation, tabs) for limiting the range of rotation of lever 70. In some other embodiments an annular seal or gasket (not shown) may be provided around the lever at the interface with the housing to prevent environmental intrusion into the interior of the housing. It is to be appreciated that, in accordance with embodiments of the invention, lever 70 may have two or more positions.

In preferred embodiments, the switch or switches generating the control signal(s) provided to the circuitry in the signal house may comprise roller switches. Lever 70 may have cams 80, 81, 82, 83 for operation with switches 60, 61, 62, 63, respectively. Cams 80, 81, 82, 83 may be positioned on a portion of lever 70 inside of housing 30, and may be integrally formed in lever 70 or attached thereto. In some embodiments, a cam may have varying radial sections. The roller portion of switch may operate as a cam follower, moving towards and away the cam as the cam rotates with the lever. It is to be appreciated that the varying radial sections of the cam may cause the roller switch to transition between two or more states. In some implementations, and without limitation, a cam may be generally circular and may have a section with a longer radial section. As the cam rotates with the roller of the roller switch following, the longer radial section of the cam outwardly displaces therefrom the switch causing the switch to toggle from a first state to a second state.

It is to be appreciated that override apparatuses in accordance with embodiments of the present invention may have any number of switches. In some examples, and without limitation, an override device comprising a single notification light and generating a single control signal to be provided to the circuitry in the signal house may comprise two switches: one switch for generating the control signal and one switch for activating the light. In some examples, a single switch can activate multiple lights. In some examples, multiple switches can provide control signals to the circuitry in the signal house. It is to be appreciated that the number of switches provided in an override apparatus in accordance with embodiments of the present invention can be made, with reference in part, to the particular circuitry in the signal house, the number of safety devices in the railway safety system, and the number of notification lights provided in the override apparatus.

Figure 12:
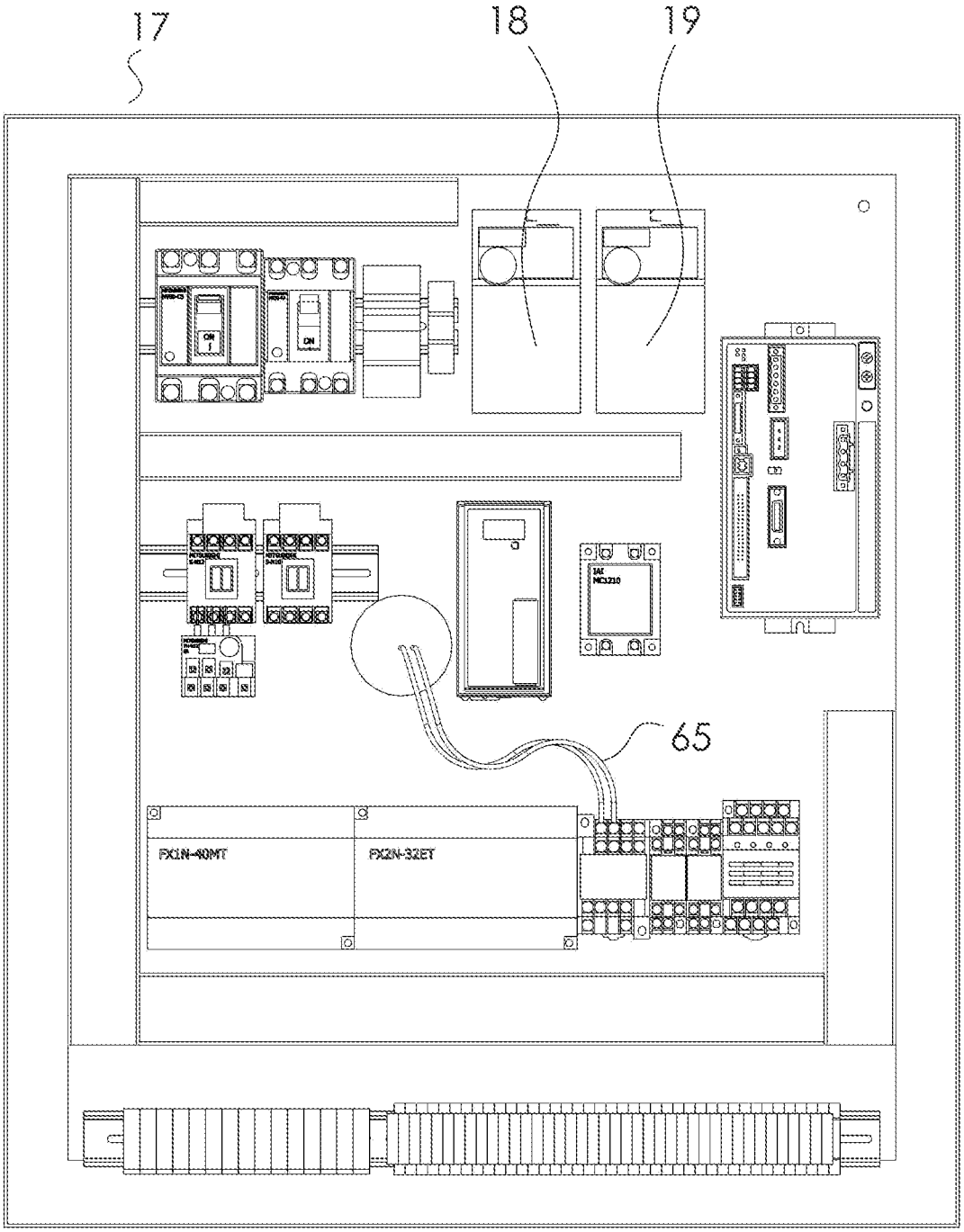
FIG. 12 is a drawing illustrating the inside of a signal house.

With reference to the exemplary illustrations of FIGS. 7, 9, and 12, the switches may be engaged via wires extending from the override apparatus to the circuitry of the signal house and generate a control signal to override the circuitry associated with a railway safety system safety device. In some examples, and without limitation, switch 60 can generate a control signal in reference to switching action imparted on switch 60 by cam 80 via rotation of lever 70, such control signal of which can be provided via wires 65 to circuitry within signal house 17. In some examples, signal house 17 may include relays 18, 19 for selectively activating and deactivating the safety devices when a train is approaching or within a railway crossing. For example, relay 18 may activate and deactivate visual notification devices of the railway safety system (such as visual notification devices 13 as illustrated in the example of FIG. 3) and relay 19 may activate and deactivate barriers vis-à-vis a motor control circuit (such as barrier 15 as illustrated in the example of FIG. 3). It is to be appreciated however that embodiments of the present invention are not limited to electrically engaging the switches of the apparatus with relays of a railway safety systems, but that embodiments of the present invention pertain to engaging the switches with any portion or device of the railway safety system circuit to override one or more safety devices.

In operation of preferred embodiments of the present invention, override apparatus 40 may have a first state where lights (for example, and without limitation, any of lights 50, 51, 52) are deactivated and flag 40 has a first position (for example, and without limitation, the position as shown in FIG. 3 and FIG. 4), and wherein the control signal generated by a switch has a first state. In some implementations, in the first state of override apparatus, lever 70 has a first position. In the first state of override apparatus 40, the railway safety system may operate normally (i.e., when trains are within or approaching the railway crossing, safety devices, as shown in FIG. 3, for example and without limitation, visual notification devices 13 are flashing or illuminated and barrier 15 is in a near horizontal position, and when trains are not within or approaching the railway crossing, as shown in FIG. 4, for example and without limitation, visual notification devices 13 are not flashing or illuminated and barrier 15 is in a near vertical position). Upon malfunction or maintenance of the railway safety system, the override apparatus 40 may be placed into a second state where lights (for example, and without limitation, any of lights 50, 51, 52) are activated and flag 40 has a second position (for example, and without limitation, the position as shown in FIG. 5), and wherein the control signal has a second state. In some implementations, the override apparatus 40 may be placed in the second state by rotation of lever 70 to a second position. When the override apparatus 20 is in the second state, it is to be appreciated that the control signal generated by the switch is provided to the circuitry in the signal house 17, which overrides the safety devices. As discussed above, conventionally when the railway safety system malfunctions or is being maintained, the safety devices are activated (for example, and without limitation, visual notification devices 13 are flashing or illuminated and barrier 15 is in a near horizontal position) regardless of whether a train is within or approaching the railway crossing. Advantageously, by utilizing the apparatuses in accordance with embodiments of the present invention, a user can place the override apparatus 20 in the second state, which causes the safety devices to be deactivated by the control signal, and provides one or more visual indications to approaching trains (for example, and without limitation, activating the lights and rotating the flag), all as illustrated in the exemplary illustration of FIG. 5. In such second state, vehicles can continue to utilize the railway crossing and approaching trains are notified that there is a malfunction or maintenance on the railway safety system.

It is to be understood that variations, modifications, and permutations of embodiments of the present invention may be made without departing from the scope thereof. It is also to be understood that the present invention is not limited by the specific embodiments, descriptions, or illustrations or combinations of either components or steps disclosed herein. Thus, although reference has been made to the accompanying figures, it is to be appreciated that these figures are exemplary and are not meant to limit the scope of the invention.

The invention claimed is:

1. An apparatus for use with a railway safety system at a railway crossing, said railway safety system having a safety device circuit for activating and deactivating a safety device, said apparatus comprising:

a) an external housing;

b) a switch engaged with said external housing and generating a control signal received by said safety device circuit;

c) a flag engaged with said external housing and having a surface with a first position and a second position; and d) a light engaged with said external housing and having a light source with a first illumination state and a second illumination state, said apparatus further comprising (i) a first state when said flag surface has said first position and said light source has said first illuminated state and (ii) a second state when said flag surface has said second position, said light source has said second illuminated state, and said control signal overrides said safety device circuit.

2. The apparatus of claim 1, wherein said flag surface is for indicating to a train approaching said railway crossing that said apparatus comprises said second state.

3. The apparatus of claim 2, wherein when said flag surface has said first position, said flag surface is positioned about parallel relative to an approach path of said train.

4. The apparatus of claim 3, wherein when said flag surface has said second position, said flag surface is positioned about perpendicular to said approach path of said train.

5. The apparatus of claim 1, wherein said light source is for indicating to a train approaching said railway crossing that said apparatus comprises said second state.

6. The apparatus of claim 5, wherein said light source is directed about parallel to an approach path of said train.

7. The apparatus of claim 5, wherein in said second illuminated state, said light source is at least partially illuminated.

8. The apparatus of claim 1, said apparatus further comprising a rotatable lever having a first position and a second position.

9. The apparatus of claim 8, wherein said lever comprises a tab, and said housing comprises at least one stopper mounted thereon adjacent to said tab of said lever.

10. The apparatus of claim 8, wherein said lever further comprises a cam and operable with said switch generating said control signal.

11. The apparatus of claim 8, wherein said flag is fixedly engaged with said lever at a distal end thereof.

12. The apparatus of claim 11, wherein said lever further comprises a handle at a proximal end thereof.

13. The apparatus of claim 1, wherein said safety device comprises a motor actuated movable gate positioned to prevent vehicles from entering into the railway crossing.

14. The apparatus of claim 1, wherein said safety device comprises an audible notification device.

15. The apparatus of claim 1, wherein said safety device comprises a visual notification device.

16. The apparatus of claim 1, wherein said safety device comprises a roadway traffic control signal.

17. The apparatus of claim 1, wherein said safety device circuit comprises an electronic relay and wherein said relay is opened and closed in response to said control signal.

18. The apparatus of claim 1, wherein said safety device circuit is positioned within a signal house adjacent to said railway crossing, and wherein said apparatus is engaged to said signal house.

19. The apparatus of claim 1, said apparatus further comprising attachment devices for engaging said housing to a signal house adjacent to said railway crossing.

20. The apparatus of claim 1, wherein when said flag surface has said first position said flag surface is positioned about parallel relative to an approach path of said train, wherein when said flag surface has said second position said flag surface is positioned about perpendicular to said approach path of said train, and wherein when said light source has said second illuminated state said light source is at least partially illuminated.

21. The apparatus of claim 1, wherein when said control signal overrides said safety device circuit said safety device is deactivated.

22. An apparatus for use with a circuit of an automatic railway safety system, said device comprising:

a) a housing having an inner cavity;

b) a rotatable lever extending through said inner cavity of said housing;

c) a flag at a distal end of said lever and positioned outside of said inner cavity of said housing;

d) a light activated and deactivated by rotation of said lever;

e) a switch inside said inner cavity of said housing and adjacent to said lever, said switch adapted to be electrically coupled to said circuit of said safety system; and e) a cam on said lever engaged with said switch.

23. A system for overriding a portion of a railway safety system comprising:

a) a safety device in a railway crossing;

b) a circuit for activating and deactivating said safety device, said circuit positioned in a signal house; and c) an override apparatus disposed proximate and external to said signal house, said override apparatus comprising a switch generating a control signal received by said circuit in said signal house, a flag having a first position and a second position, and a light, wherein said circuit in said signal house is adapted to deactivate said safety device in response to said control signal.

24. The system of claim 23, further comprising a first state and a second state, wherein in said first state said safety device is activated, said flag has said first position, and said light is deactivated, and wherein in said second state, said circuit in said signal house is overridden, said safety device is deactivated, said flag has said second position, and said light is activated.

25. The system of claim 24, wherein in said second position, each said flag and said light provide a visual indication to a train approaching said railway crossing that said safety device is deactivated.

26. The system of claim 25, said override apparatus further comprising a lever with a cam operably engaged with said switch, said lever having said flag engaged at a distal end thereof.

27. The system of claim 23, said circuit in said signal house comprising a relay activating and deactivating said safety device, wherein said switch is electrically coupled to said relay.

28. An apparatus for use with an automatic railway safety system having a safety device and a signal house containing a circuit for enabling and disabling said safety device, said apparatus comprising:

a) a housing positioned to be visible along an approach path of a train;

b) a rotatable lever extending through a portion of said housing, said lever having a handle at a proximal end thereof;

c) a flag at a distal end of said lever, said flag having a surface with a first position about parallel relative to said approach path and a second position about perpendicular to said approach path;

d) a light on said housing and activated and deactivated by rotation of said lever; and e) at least one cam on said lever engaged with a switch adapted to be electrically coupled with said safety device circuit for overriding said safety device circuit and disabling said safety device.

* * * * *